US005474047A

United States Patent [19]

Cochard et al.

[11] Patent Number: 5,474,047

[45] Date of Patent: Dec. 12, 1995

[54] PROCESS FOR SUPPLYING FUEL TO AN INTERNAL COMBUSTION ENGINE AND ENGINE FOR USING IT

[75] Inventors: Pierre Cochard, St-Vrain; Bernard Vallee, Bretigny-Sur-Orge, both of France

[73] Assignee: Regie Nationale Des Usines Renault S.A., Boulogne-Billancourt, France

[21] Appl. No.: 299,650

[22] Filed: Sep. 2, 1994

[30] Foreign Application Priority Data

Sep. 9, 1993 [FR] France ..... 93 10709

[51] Int. Cl.[6] ..... F02M 51/00; F02M 33/02; F02N 17/00

[52] U.S. Cl. ..... 123/491; 123/179.15; 123/520; 123/576; 123/544

[58] Field of Search ..... 123/518, 519, 123/520, 525, 179.15, 179.21, 491, 544, 545, 548, 576, 179.12, 179.13, 179.14, 179.15, 491

[56] References Cited

U.S. PATENT DOCUMENTS

| | | | |
|---|---|---|---|
| 3,851,633 | 12/1974 | Shih | 123/576 |
| 3,906,915 | 9/1975 | Bednarczyk et al. | 123/576 |
| 4,308,846 | 1/1982 | Cochard . | |
| 4,475,522 | 10/1984 | Oonaka | 123/520 |
| 4,520,764 | 6/1985 | Ozawa et al. | 123/179.15 |
| 4,606,319 | 8/1986 | Silva | 123/576 |
| 4,778,495 | 10/1988 | Bishop et al. | 123/519 |
| 4,829,968 | 5/1989 | Onufer | 123/520 |
| 4,864,103 | 9/1989 | Bishop et al. | 123/519 |
| 5,021,071 | 6/1991 | Reddy . | |
| 5,048,493 | 9/1991 | Orzel et al. . | |
| 5,224,456 | 7/1993 | Hosoda et al. . | |
| 5,349,934 | 9/1994 | Miyano | 123/525 |
| 5,357,908 | 10/1994 | Sung et al. | 123/576 |
| 5,377,644 | 1/1995 | Krohm | 123/520 |

*Primary Examiner*—Thomas N. Moulis
*Attorney, Agent, or Firm*—Oblon, Spivak, McClelland, Maier & Neustadt

[57] ABSTRACT

A process for supplying fuel to an internal combustion engine of the multi-cylinder type with controlled fuel injection and comprising a controlled fuel vapor recovery system. During predetermined operating phases of the engine, the fuel injection is stopped for a given period, while the fuel vapors trapped in the recovery system are recycled into an intake circuit of the engine.

12 Claims, 1 Drawing Sheet

PROCESS FOR SUPPLYING FUEL TO AN INTERNAL COMBUSTION ENGINE AND ENGINE FOR USING IT

BACKGROUND OF THE INVENTION

1. Field of the Invention

The present invention relates to a process for supplying fuel to an internal combustion engine intended to equip a motor vehicle. The present invention relates more particularly to a process for supplying fuel that is suited to the starting phase of the engine. The invention also relates to an internal combustion engine suited to the use of the process.

2. Discussion of the Related Art

The standards relating to pollution and to fuel consumption of motor vehicles equipped with internal combustion engines become stricter every day. The automobile industry today is therefore occupied with finding technical solutions to respond to these requirements without overly restricting the performance of the vehicles or affecting their cost.

It is known to reduce fuel consumption and the emissions of pollutants of engines, by manipulating the supply of fuel of the combustion chambers due to an electronic fuel injection device comprising one or more electronic injectors placed on the intake circuit of the combustion air, and an electronic control system which calculates and controls the flow rate of the injector or of the various injectors from values taken from a certain number of operating parameters of the engine.

However, in certain circumstances and particularly during cold-starting phases, the liquid fuel injected is mixed poorly with the combustion air and is condensed on the walls of the intake pipes. It is then necessary to greatly increase the richness of the aspirated mixture to assure the starting of the engine, which causes an excess consumption of fuel and a high emission of polluting substances.

Various systems have been developed to eliminate these drawbacks and to speed up the vaporization of the fuel during the starting phase. It is possible to cite, for example, air blanket injectors where an auxiliary air jet sprays the fuel at the outlet of the injector nose, or heating resistors of the PTC type placed in the intake manifold to cause the vaporization of the fuel. These various devices are, however, costly, difficult to maintain and difficult to control.

SUMMARY OF THE INVENTION

An object of this invention is therefore to propose a process for supplying fuel to an internal combustion engine and its device for use, a process which makes it possible to greatly reduce the richness of the aspirated mixture in starting phase and in a very simple way.

The principle of the process for supplying fuel to an internal combustion engine according to the invention involves using, during the starting phase, not the liquid fuel contained in the corresponding tank but fuel vapors previously trapped in a fuel vapor recovery system or canister which equips the engine for that reason.

Actually, the fight against pollution has brought into widespread use the equipping of internal combustion engines with systems for recovery of fuel vapors to prevent evaporations into the air of the transported fuel, evaporations which otherwise would be the cause of considerable pollution of the atmosphere. These systems comprise in a standard way a filter which contains a material that adsorbs the fuel vapors such as activated carbon. This filter, in a standard way, is connected by a first pipe to the upper part of the fuel tank, by a second pipe to the air intake circuit of the engine, and by a third pipe to an air source for regenerating the adsorbent material.

These systems thus make it possible to trap the fuel vapors which come from the tank, particularly during engine stopping phases, when the gas current passes from the first pipe to the third by going through the filter. The system is regenerated during the operation of the engine, when it is reverse-scavenged by the regeneration air passing from the third pipe to the second. The fuel vapors are then burned in the combustion chambers of the engine. The regeneration phase is generally controlled thanks to a vent solenoid valve placed on the second pipe.

The process according to the invention relates to the supplying of fuel to an internal combustion engine of the multicylinder type with fuel injection controlled by an electronic system of engine control and comprising a controlled system for recovery of fuel vapors.

According to the invention, the device is characterized in that during predetermined operating phases of the engine, the injection of fuel is stopped for a given period, while the fuel vapors trapped in the recovery system are recycled in the intake circuit of the engine.

According to another characteristic of the process for supplying fuel according to the invention, these predetermined engine operating phases comprise the cold-starting phase of the engine and are defined by the values of one or more representative parameters of the operation of the engine.

According to another characteristic of the process for supplying fuel according to the invention, the given period of stopping the injection is calculated as a function of the amount of fuel vapor present in the recovery system.

According to another characteristic of the process for supplying fuel according to the invention, the preparation of the combustible mixture, fuel vapors and combustion air, is performed in the main intake circuit of the engine, the recovery system being isolated by stopper means from any source of scavenging of auxiliary air.

According to another characteristic of the process for supplying fuel according to the invention, the flow rate of the recycled fuel vapors is adjusted by control means to the needs of the engine.

According to another characteristic of the process for supplying fuel according to the invention, the recycling of the fuel vapors is activated by the use of heating means that cooperate with the fuel vapor recovery system.

The invention also relates to an internal combustion engine suited for the use of the supply process. The engine according to the invention comprises a combustion air intake circuit, at least one controlled fuel injector, a fuel vapor recovery system that is connected to the air intake circuit and whose various pipes are equipped with controlled valves, controlled heating means cooperating with the fuel vapor recovery system and an electronic control system which, depending on the values taken from one or more representative parameters of the operation of the engine, selectively controls the use of the injector, of the valves and of the heating means, so as to allow the stopping of the fuel injection for a given period while the fuel vapors trapped in the recovery system are recycled into the intake circuit of the engine.

Accordingly, the present invention relates to a process for supplying fuel to a multi-cylinder type internal combustion engine having fuel injection controlled by an engine control system and comprising a controlled fuel vapor recovery system. The process comprises the steps of stopping fuel injection for a given period while fuel vapors trapped in the fuel vapor recovery system are recycled in an intake circuit of the engine during operating phases defined by values of one or more representative parameters of operation of the engine and comprising a cold-starting phase of the engine; and activating a recycling of the fuel vapors by using heating means which cooperate with the fuel vapor recovery system.

The present invention also relates to an internal combustion engine which comprises a combustion air intake circuit; at least one controlled fuel injector; a fuel vapor recovery system connected to the air intake circuit and having pipes which are equipped with controlled valves; controlled heating means cooperating with the fuel vapor recovery system; and an electronic control system which selectively controls the at least one injector, the controlled valves of the pipes and the heating means, depending on values taken from at least one representative parameter of the operation of the engine, so as to allow a stopping of fuel injection for a given period, while fuel vapors trapped in the recovery system are recycled into the air intake circuit of the engine.

BRIEF DESCRIPTION OF THE DRAWING

A more complete appreciation of the invention and many of the attendant advantages thereof will be readily obtained as the same becomes better understood by reference to the following detailed description when considered in connection with the accompanying drawings, wherein.

DESCRIPTION OF THE PREFERRED EMBODIMENT

Figure 1:
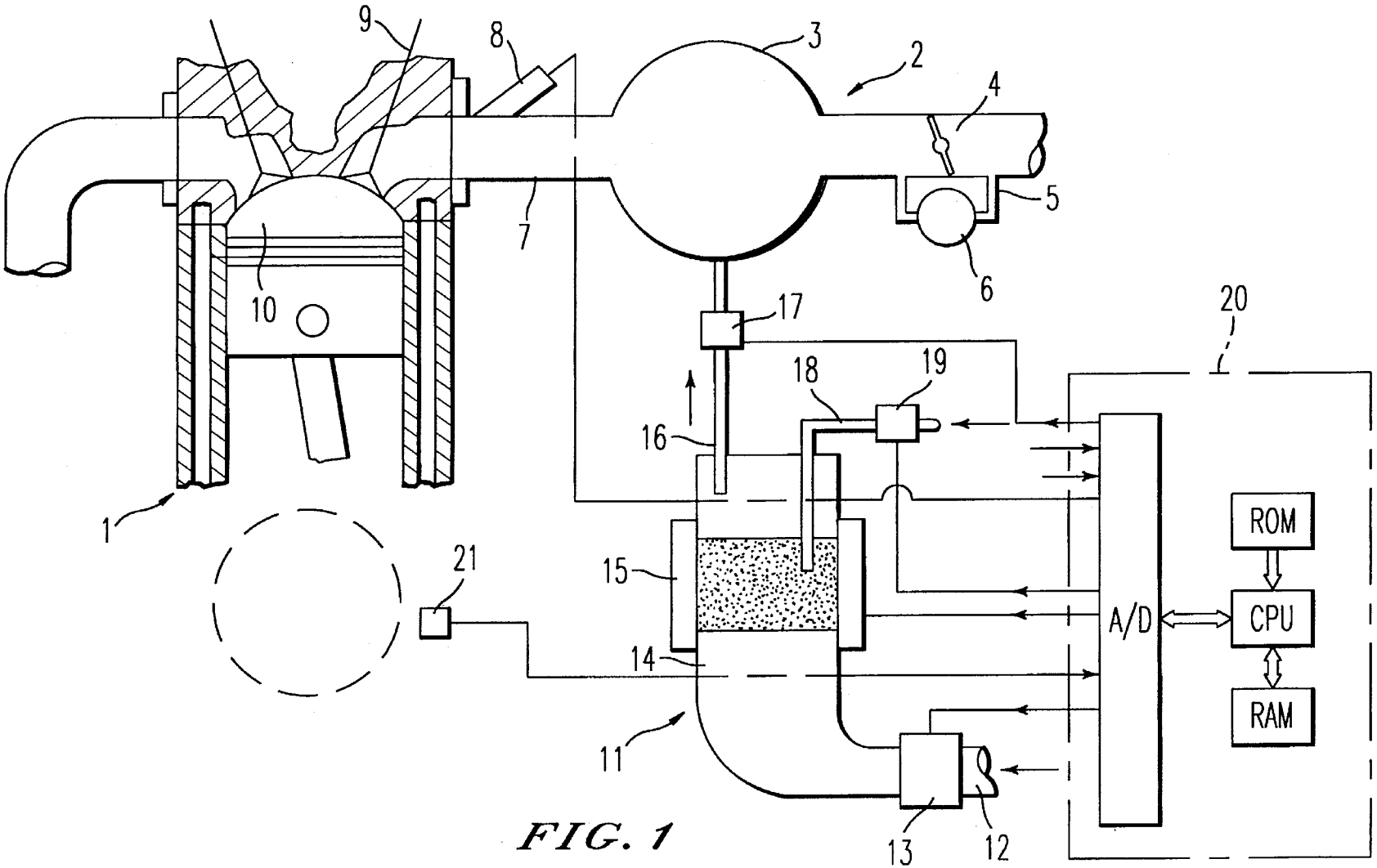
FIG. 1 is a diagrammatic view in section of an internal combustion engine according to the invention.

FIG. 1 describes an internal combustion engine of the multi-cylinder type for a motor vehicle or road vehicle. Only the elements necessary for understanding the invention have been represented.

The engine, referenced 1, is equipped in a standard way with a combustion air intake circuit intended for filling the cylinders. This circuit comprises an air filter not shown, a main air duct 2, a distributor 3 and several intake ducts 7 coming out into the various cylinders 10 through openings controlled by rod valves 9, only one duct and its associated cylinder have been shown. The main duct 2 is provided with a butterfly housing 4 and with a bypass duct 5 equipped with a regulation valve 6 for the operation of the engine at idle speed.

In the embodiment shown, the supply of fuel is of the multi-point indirect electronic ignition type, each intake duct 7 is therefore provided with an electronic fuel injector 8 placed upstream from rod valve 9.

The opening of each electronic injector 8, and 10 therefore the injection of the fuel, is controlled by an electronic control system or microcontroller 20, which determines the moment of injection and the amount of fuel to be injected depending on the values taken from various parameters acting on the operation of engine 1.

In engine control system 20, fundamental parameters for the optimal regulating of the engine are therefore stored, the parameters being obtained previously on the test bank of the engine. These are, for example, the parameters relating to the fuel injection phase in each cylinder of the engine, the duration of fuel injection which corresponds to an amount of injected fuel, or else the ignition phase of the sparkplugs, not shown.

Electronic system 20 comprises in a standard way a central processing unit CPU, a random access memory RAM, a read-only memory ROM, analog-digital converters A/D, and various input and output interfaces. The electronic system 20 receives input signals relating to the operation of the engine and of the elements that interact with the latter, performs operations and generates output signals intended in particular for injectors 8. The various engine control strategies, formulas and parameters or calibrations are stored in the read-only memory ROM.

Of the input signals there appear in particular those emitted by a crankshaft sensor 21 which make possible the identifying of the passage of the top dead center in each of the cylinders 10, and the determination of the speed of rotation of the engine. These signals, coupled with those emitted by a cam shaft sensor not shown, make it possible to phase the injection moments with the operation of the engine.

The engine 1 also comprises a canister or fuel vapor recovery system 11 which comes in particular from the fuel tank.

Fuel vapor recovery system 11 comprises in a standard way a filter 14 containing a material that adsorbs the fuel vapors, such as activated carbon. This filter 14 is connected in a standard way by a first pipe 18 to the upper part of the fuel tank, by a second pipe 16 provided with a variable flow rate solenoid valve 17 known as a canister vent valve to a partial vacuum source consisting of the combustion air intake circuit of the engine, and by a third pipe 12 to an air source for regenerating the adsorbent material.

The filter, during an initial period, adsorbs the fuel vapors escaping from the tank under pressure through first pipe 18 toward the atmosphere via third pipe 12. In a second period it is regenerated by a reverse scavenging by air passing from third pipe 12 toward the second pipe 16 after opening of vent valve 17. The fuel vapors are then recycled into the intake circuit and are burned in the cylinders.

Solenoid valve 17 is controlled by engine control system 20, to control the regeneration of the filter 14 so as to prevent saturation of the filter and so as to perform the venting at predetermined moments of engine operation.

Fuel vapor recovery system 11 is completed by electric heating means 15 cooperating with filter 14 to facilitate the desorption of the fuel vapors during the regeneration phase, the use of these heating means 15 being controlled by the engine control system 20, and by two other solenoid valves 19, 13 also controlled by the control system 20 and controlling the circulation of the gases through the first and third pipes 18, 12, respectively.

In accordance with the invention, the operation of the engine according to the invention is then as follows. During starting of the engine, the control system 20 then controls for a given period, the electric power supply of the heating means 15, the closing of solenoid valves 19 and 13 and the opening of solenoid valve 17 and simultaneously suspends the control of electronic injectors 8.

The heating of filter 14 causes the desorption of the fuel vapors, the increase of the pressure in the filter 14 then is combined with the partial vacuum prevailing in intake circuit 2 to cause the circulation of the fuel vapors toward the cylinders of the engine and their mixture with the combustion air. The supplying of fuel to the engine is then only performed by the fuel vapors released by the filter 14. The flow rate of the vapors is adjusted to the need of the engine by regulating the opening of variable flow rate valve 17.

The given period being ended, engine control system 20 reactivates the control of electronic injectors 8, closes solenoid valve 17, opens solenoid valves 13 and 19 and cuts off the electric power supply of heating means 15. The supplying of fuel to the engine is then performed in a standard way by injectors 8. As for fuel vapor recovery system 11, it is then controlled according to ordinary strategies.

The period during which the supplying of fuel is only assured by the fuel vapors contained in the canister begins with the actuation of the starter and ends at a moment determined by the engine control system as a function of the estimation of the amount of fuel contained in the filter deduced from a piece of information of vapor pressure in the canister provided by a pressure sensor not shown. It is also possible to provide, in the case where the engine is equipped with an exhaust line provided with a catalytic converter, to provide for the reactivation of the injectors once the initiation of the catalyst is accomplished.

Thus, the engine according to the invention is supplied during the first moments of operation, while it is still cold, with a thoroughly homogeneous combustible mixture where all the fuel is present in the form of vapors, which makes it possible to obtain a maximum efficiency and therefore lower consumption and a considerable reduction in the emission of polluting substances.

Since the fuel vapors trapped by filter 14 are essentially composed of volatile substances, their vaporization is therefore extremely quick, which therefore makes possible a good preparation of the air-fuel mixture and eliminates the dangers of wetting the still-cold walls that liquid fuel injection ordinarily causes.

Of course, the invention is in no way limited to the embodiment described and illustrated which has been given only by way of example. Rather, the invention comprises all the technical equivalents of the means described as well as their combinations if they are made according to its spirit.

Thus, the previously described embodiment proposes the preparation of the combustible mixture in the main intake circuit by not permitting, by solenoid valves 19 and 13, the secondary air intake through pipes 18 and 12 and this to better control the richness of the mixture. However, it is possible to envisage the preparation of the mixture directly in filter 14 by allowing, in particular, the passage of air through the third pipe 12, it is then advisable to provide a non-return valve in this pipe to prevent the fuel vapors under pressure from flowing back to the atmosphere.

Obviously, numerous modifications and variations of the present invention are possible in light of the above teachings. It is therefore to be understood that within the scope of the appended claims, the invention may be practiced otherwise than as specifically described herein.

What is claimed as new and desired to be secured by letters patent of the United States is:

1. A process for supplying fuel to a multi-cylinder type internal combustion engine having fuel injection controlled by an engine control system and comprising a controlled fuel vapor recovery system, the process comprising the steps of:

stopping a fuel injection for a given period while fuel vapors trapped in said fuel vapor recovery system are recycled in an intake circuit of the engine during operating phases defined by values of one or more representative parameters of operation of the engine, the operating phases comprising a cold-starting phase of the engine; and activating a recycling of the fuel vapors by using heating means which cooperate with the fuel vapor recovery system.

2. A process for supplying fuel to an internal combustion engine according to claim 1, wherein the given period of stopping the injection is calculated as a function of an amount of fuel vapor present in said fuel vapor recovery system.

3. A process for supplying fuel to an internal combustion engine according to claim 1, comprising the further steps of:

performing a preparation of a combustible mixture, fuel vapors and combustion air in the main intake circuit of the engine; and isolating the fuel vapor recovery system by stopper means from any source of scavenging of auxiliary air.

4. A process for supplying fuel to an internal combustion engine according to claim 2, comprising the further steps of:

performing a preparation of a combustible mixture, fuel vapors and combustion air in the main intake circuit of the engine; and isolating the fuel vapor recovery system by stopper means from any source of scavenging of auxiliary air.

5. A process for supplying fuel to an internal combustion engine according to claim 1, comprising the further step of:

adjusting a flow rate of the recycled fuel vapors to requirements of the engine by control means.

6. A process for supplying fuel to an internal combustion engine according to claim 2, comprising the further step of:

adjusting a flow rate of the recycled fuel vapors to requirements of the engine by control means.

7. A process for supplying fuel to an internal combustion engine according to claim 3, comprising the further step of:

adjusting a flow rate of the recycled fuel vapors to requirements of the engine by control means.

8. A process for supplying fuel to an internal combustion engine according to claim 4, comprising the further step of:

adjusting a flow rate of the recycled fuel vapors to requirements of the engine by control means.

9. An internal combustion engine comprising:

a combustion air intake circuit;

at least one controlled fuel injector;

a fuel vapor recovery system connected to said air intake circuit and having pipes which are equipped with controlled valves;

controlled heating means cooperating with said fuel vapor recovery system; and an electronic control system which selectively controls the at least one injector, the controlled valves of the pipes and the heating means depending on values taken from at least one representative parameter of the operation of the engine, so as to allow a stopping of fuel injection for a given period, while fuel vapors trapped in said recovery system are recycled into the air intake circuit of the engine.

10. A process for supplying fuel to an internal combustion engine according to claim 1, wherein said fuel vapor recovering system comprises a filter such that said heating means heats said filter to cause a desorption of fuel vapors trapped in said filter.

11. An internal combustion engine according to claim 9, wherein said electronic control system stops the fuel injection for said given period during a cold-starting phase of the engine.

12. An internal combustion engine according to claim 9, wherein said fuel vapor recovery system comprises a canister having a filter positioned therein, said controlled heating means being positioned on said canister with respect to said filter so as to cause a desorption of fuel vapors trapped in said filter.

* * * * *